US010726815B2

(12) United States Patent
Yang et al.

(10) Patent No.: US 10,726,815 B2
(45) Date of Patent: Jul. 28, 2020

(54) IMAGE PROCESSING APPARATUS, DISPLAY PANEL AND DISPLAY APPARATUS

(71) Applicant: Novatek Microelectronics Corp., Hsinchu (TW)

(72) Inventors: Hsueh-Yen Yang, Taoyuan (TW); Ching-Pei Cheng, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 16/387,544

(22) Filed: Apr. 18, 2019

(65) Prior Publication Data

US 2019/0244588 A1 Aug. 8, 2019

Related U.S. Application Data

(62) Division of application No. 15/806,346, filed on Nov. 8, 2017.

(Continued)

(51) Int. Cl.
*G09G 5/391* (2006.01)
*G09G 5/04* (2006.01)

(Continued)

(52) U.S. Cl.
CPC ..... *G09G 5/391* (2013.01); *G09G 3/2003* (2013.01); *G09G 3/2092* (2013.01); *G09G 5/006* (2013.01);

(Continued)

(58) Field of Classification Search
CPC ... G09G 2300/0426; G09G 2300/0443; G09G 2300/0452; G09G 2300/08; G09G 2310/06; G09G 2340/02; G09G 2340/0457; G09G 2360/18; G09G 3/2003; G09G 3/2092; G09G 5/006; G09G 5/04; G09G 5/391
See application file for complete search history.

(56) References Cited

U.S. PATENT DOCUMENTS

2005/0225548 A1* 10/2005 Han ..... G09G 5/006 345/213
2011/0050753 A1* 3/2011 Li ..... G09G 3/3614 345/690

(Continued)

FOREIGN PATENT DOCUMENTS

TW 200926118 6/2009
TW I428878 3/2014

OTHER PUBLICATIONS

"Office Action of Taiwan Counterpart Application", dated May 16, 2019, pp. 1-7.

*Primary Examiner* — Hong Zhou
(74) *Attorney, Agent, or Firm* — JCIPRNET

(57) ABSTRACT

A display apparatus including a display panel, an image data processor unit and a display driver is provided. The image data processor unit is configured to generate a plurality of partial output frames according to a plurality of input frames. With respect to one pixel in the display panel, each partial output frame among the partial output frames includes a part, instead of all, of sub-pixel data to be displayed by the pixel. The display driver is coupled to the image data processor unit and a data signal input terminal of the display panel. In addition, a display panel is also provided.

7 Claims, 18 Drawing Sheets

Related U.S. Application Data

(60) Provisional application No. 62/504,519, filed on May 10, 2017, provisional application No. 62/418,811, filed on Nov. 8, 2016.

(51) Int. Cl.
*G09G 3/20* (2006.01)
*G09G 5/00* (2006.01)

(52) U.S. Cl.
CPC ..... *G09G 5/04* (2013.01); *G09G 2300/0426* (2013.01); *G09G 2300/0443* (2013.01); *G09G 2300/0452* (2013.01); *G09G 2300/08* (2013.01); *G09G 2310/06* (2013.01); *G09G 2340/02* (2013.01); *G09G 2340/0457* (2013.01); *G09G 2360/18* (2013.01)

(56) References Cited

U.S. PATENT DOCUMENTS

2011/0148908 A1* 6/2011 Jeong ..... G09G 5/02 345/590
2012/0120083 A1* 5/2012 Kong ..... G09G 5/003 345/545
2013/0127796 A1* 5/2013 Li ..... G09G 5/00 345/204
2014/0159798 A1* 6/2014 Duan ..... G09G 3/3611 327/434
2015/0324981 A1* 11/2015 Kim ..... A61N 5/0618 345/619
2016/0027396 A1* 1/2016 Li ..... G09G 3/3614 345/212
2016/0275888 A1* 9/2016 Chen ..... G09G 3/3614

* cited by examiner

IMAGE PROCESSING APPARATUS, DISPLAY PANEL AND DISPLAY APPARATUS

CROSS-REFERENCE TO RELATED APPLICATION

This application is a divisional application of and claims the priority benefit of a prior application Ser. No. 15/806,346, filed on Nov. 8, 2017. The prior application Ser. No. 15/806,346 claims the priority benefits of U.S. provisional application Ser. No. 62/418,811, filed on Nov. 8, 2016 and U.S. provisional application Ser. No. 62/504,519, filed on May 10, 2017. The entirety of each of the above-mentioned patent applications is hereby incorporated by reference herein and made a part of this specification.

BACKGROUND OF THE INVENTION

1. Field of the Invention

The invention relates to an image processing apparatus, a display panel and a display apparatus.

2. Description of Related Art

With blooming development in display technology, market demands for performance requirements of a display panel are advancements in high resolution, high brightness and low-power consumption. However, with improved resolution of the display panel, because an amount of sub-pixels on the display panel will also increase for displaying in high resolution, the manufacturing cost is also increased accordingly. In order to reduce the manufacturing cost of the display panel, a sub-pixel rendering method (SPR method) has been proposed. A display apparatus generally uses different arrangements and designs of the sub-pixels to formulate a proper algorithm so an image resolution visible by human eyes (i.e., a visual resolution) can be improved.

Besides, in comparison with a data quantity of pixel data not processed by the SPR method, the pixel data processed by the SPR method can provide a reduced data quantity, which is conducive to data transmission. In addition, a suitable sub-pixel rendering can prevent an image display quality from being reduced.

SUMMARY OF THE INVENTION

The invention is directed to an image processing apparatus, a display panel and a display apparatus, with a data processing including a sub-pixel rendering operation capable of reducing a data transmission amount.

The display panel of the invention includes a pixel row, a scan signal input terminal, a scan line group and a scan signal switching unit. The pixel row includes a plurality of pixels, and each of the pixels includes a plurality of sub-pixels. The scan line group includes a plurality of scan lines. The number of sub-pixels coupled to each of the scan lines is less than the number of sub-pixels included in the pixel. The scan signal switching unit is configured to couple a scan signal input terminal to one scan line in the scan line group.

In an embodiment of the invention, one pixel in the pixel row is driven by a plurality of sub-pixel data corresponding to the pixel, which are respectively included in a plurality of output frames corresponding to a plurality of consecutive frame periods. Each of the output frames includes a part, instead of all, of sub-pixel data to be displayed by the pixel.

The display apparatus of the invention includes a display panel and an image data processor unit and a display driver. The display panel includes a pixel row, a data signal input terminal, a data line group, a data signal switching unit, a scan signal input terminal, a scan line group and a scan signal switching unit. The pixel row includes a plurality of pixels. Each of the pixels includes K sub-pixels, wherein K is a positive integer. The data line group includes N data lines respectively coupled to N sub-pixels, wherein N is a positive integer. The data signal switching unit is configured to couple the data signal input terminal to one data line in the data line group. The scan line group includes M scan lines. The number of sub-pixels coupled to each of the scan lines is less than the number of sub-pixels included in the pixel, wherein M is a positive integer. The scan signal switching unit is configured to couple a scan signal input terminal to one scan line in the scan line group. The image data processor unit is configured to generate a plurality of partial output frames according to a plurality of input frames. With respect to one pixel in the display panel, each partial output frame among the partial output frames includes a part, instead of all, of sub-pixel data to be displayed by the pixel. The display driver is coupled to the image data processor unit and the data signal input terminal of the display panel.

In an embodiment of the invention, the input frames are included in a cycle with every P input frames per one cycle. With respect to the pixel in the display panel, the image data processor unit performs a sub-pixel data rendering operation on a plurality of sub-pixel data related to a part, instead of all, of sub-pixels in the pixel in each of the input frames, so as to generate a plurality of sub-pixel data to be displayed by the part of the sub-pixels in the pixel in each of the partial output frames, wherein P is an integer greater than or equal to 2.

In an embodiment of the invention, the sub-pixel rendering operation includes calculating a plurality of sub-pixel data having an identical color in each of the input frames by the image data processor unit according to a set of color diffusion ratios, so as to generate a sub-pixel data to be displayed by the pixel in each of the partial output frames.

In an embodiment of the invention, the input frame includes a first input frame and a second input frame temporally subsequent to the first input frame. The image data processor unit performs the sub-pixel rendering operation on a plurality of first-color sub-pixel data in the first input frame, so as to generate the corresponding first-color sub-pixel data to be displayed by the pixel in a first partial output frame. The image data processor unit performs the sub-pixel rendering operation on a plurality of second-color sub-pixel data in the second input frame, so as to generate the corresponding second-color sub-pixel data to be displayed by the pixel in a second partial output frame.

In an embodiment of the invention, the display apparatus includes a processor. The image data processor unit is disposed in the processor. The processor outputs the partial output frame to the display driver. The display driver generates one or more corresponding data voltages according to the part of the sub-pixel data corresponding to the pixel in each of the partial output frames for driving a part, instead of all, of sub-pixels in the pixel.

In an embodiment of the invention, the display driver is further coupled to the scan signal input terminal of the display panel. In a period during which the display driver outputs the scan signal to one scan line in the scan line group through the scan signal switching unit, the display driver outputs said one or more corresponding data voltages through the data signal switching unit for driving the part of the sub-pixels in the pixel.

In an embodiment of the invention, the processor further includes an image compression unit. The image compression unit is configured to compress the partial output frames and output the compressed partial output frames. The display driver further includes an image data processor unit. The image decompression unit is configured to decompress the compressed partial output frames, so as to generate the decompressed partial output frames.

To make the above features and advantages of the disclosure more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
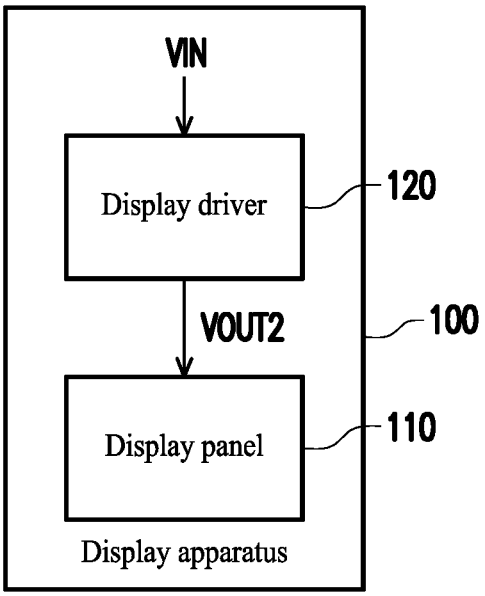
FIG. 1 is a schematic diagram illustrating a display apparatus in an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

FIG. 1 is a schematic diagram illustrating a display apparatus in an embodiment of the invention. With reference to FIG. 1, a display apparatus 100 of the present embodiment includes a display panel 110 and a display driver 120. The display panel 110 is coupled to the display driver 120. The display apparatus 100 of FIG. 1 is, for example, an electronic apparatus such as cell phone, a tablet computer or notebook computer, which may include an image input unit. Further, the display driver 120 sequentially receives each input frame VIN in a plurality of input frames from the image input unit. In the present embodiment, the display driver 120 may be regarded as an image data processing apparatus. The display driver 120 includes, for example, an image data processor unit, which is configured to perform a sub-pixel rendering operation on each input frame VIN, so as to generate one corresponding partial output frame VOUT1. Further, a plurality of partial output frames continuously generated by the image data processor unit can be reconstructed by the display driver 120 to generate an output frame VOUT2. The display driver 120 drives the display panel 110 according to the output frame VOUT2. In the present embodiment, the display panel 110 is, for example, a display panel such as a liquid crystal display panel or an organic light-emitting diode panel, but the type of the display panel 110 is not particularly limited in the invention.

Figure 2C:
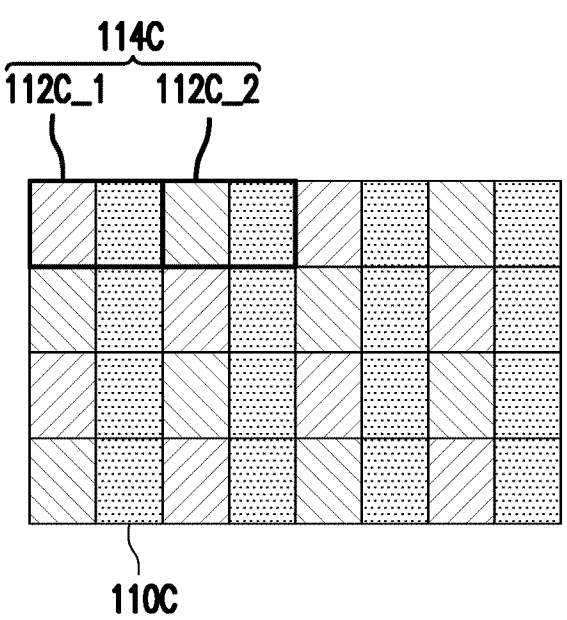
FIG. 2A, FIG. 2B and FIG. 2C are schematic diagrams illustrating pixel arrangements of a display panel in the embodiment of FIG. 1.
Figure 2B:
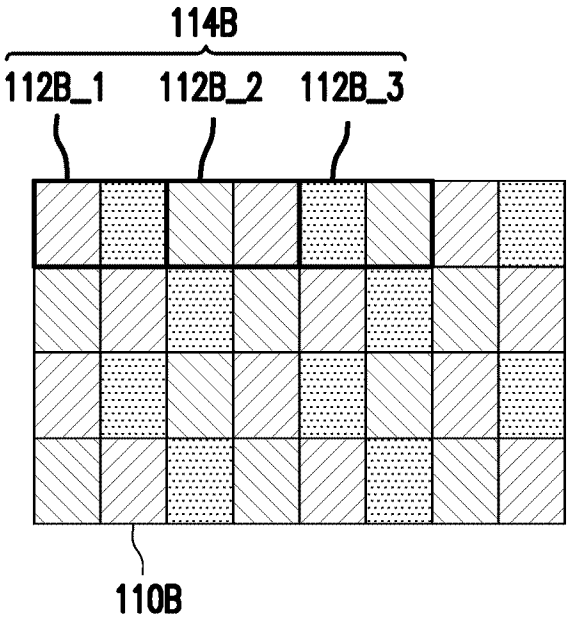
Figure 2A:
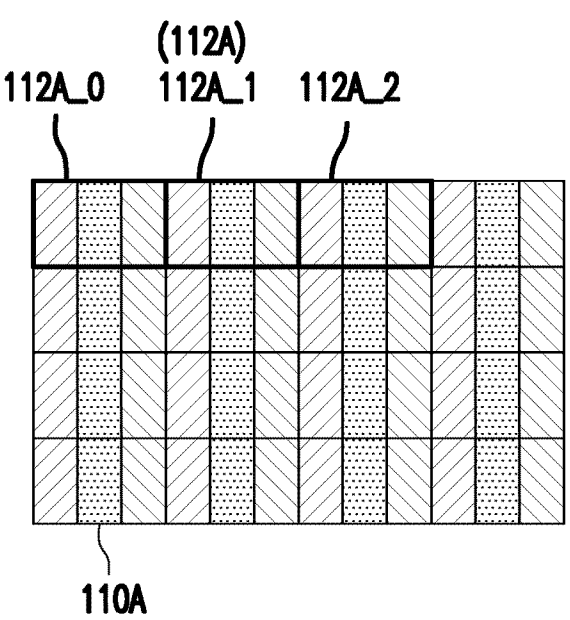

FIG. 2A to FIG. 2C are schematic diagrams illustrating pixel arrangements of a display panel in the embodiment of FIG. 1. A display panel 110A illustrated in FIG. 2A is, for example, a full color display panel. Each pixel 112A in the display panel 110A includes sub-pixels in three colors, which are red, green and blue. Herein, each pixel is a pixel repeating unit, repeatedly arranged to form the display panel 110A. A display panel 110B illustrated in FIG. 2B is, for example, an exemplary embodiment of a sub-pixel rendering (SPR) display panel. The display panel 110B includes a pixel repeating unit 114B. The pixel repeating unit 114B is repeatedly arranged to form the display panel 110B. The pixel repeating unit 114B includes a pixel 112B_1, a pixel 112B_2 and a pixel 112B_3. The pixel 112B_1 includes a red sub-pixel and a green sub-pixel. The pixel 112B_2 includes a blue sub-pixel and the red sub-pixel. The pixel 112B_3 includes the green sub-pixel and the blue sub-pixel. A display panel 110C illustrated in FIG. 2C is, for example, another exemplary embodiment of the SPR display panel. The display panel 110C includes a pixel repeating unit 114C. The pixel repeating unit 114C is repeatedly arranged to form the display panel 110C. The pixel repeating unit 114C includes a pixel 112C_1 and a pixel 112C_2. The pixel 112C_1 includes a red sub-pixel and a green sub-pixel. The pixel 112C_2 includes a blue sub-pixel and the green sub-pixel. In the exemplary embodiments of the invention, the type of the SPR display panel is not limited by those illustrated in FIG. 2B and FIG. 2C.

Figure 3A:
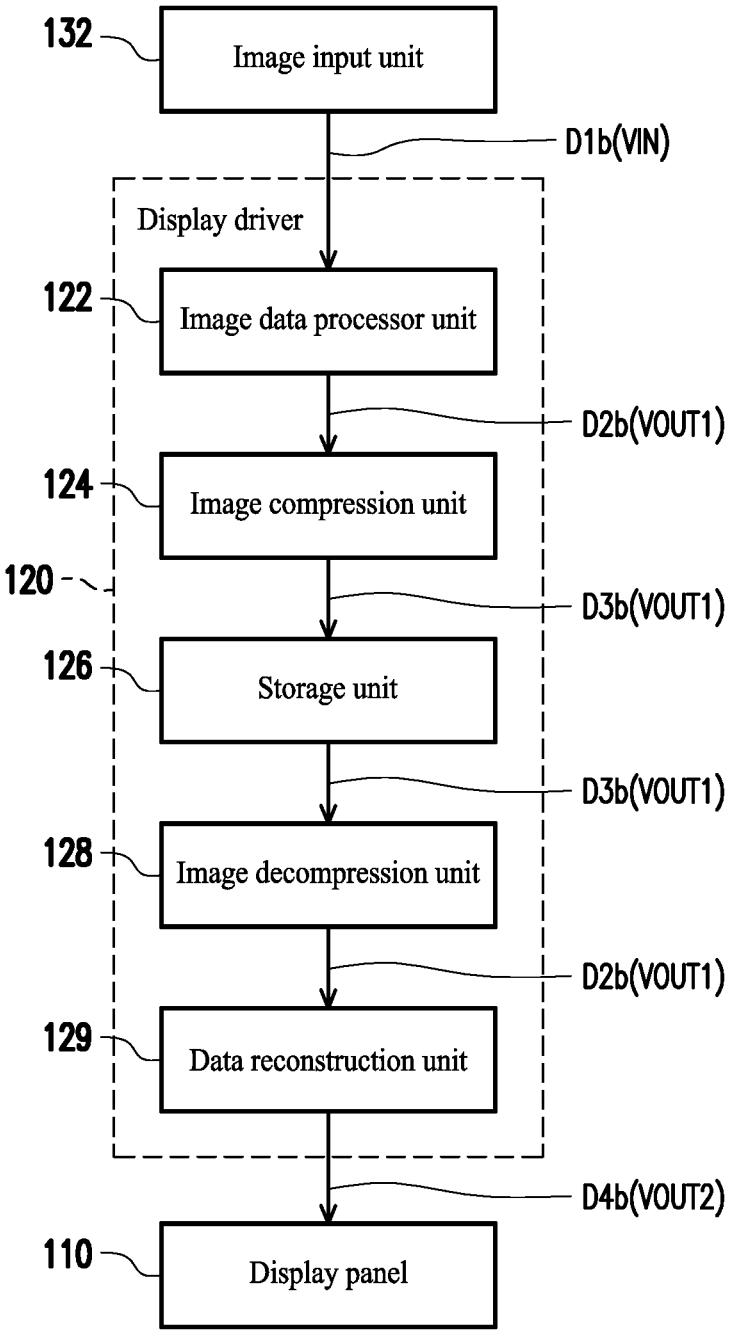
FIG. 3A is a schematic diagram of the display driver in the embodiment of FIG. 1.
Figure 3B:
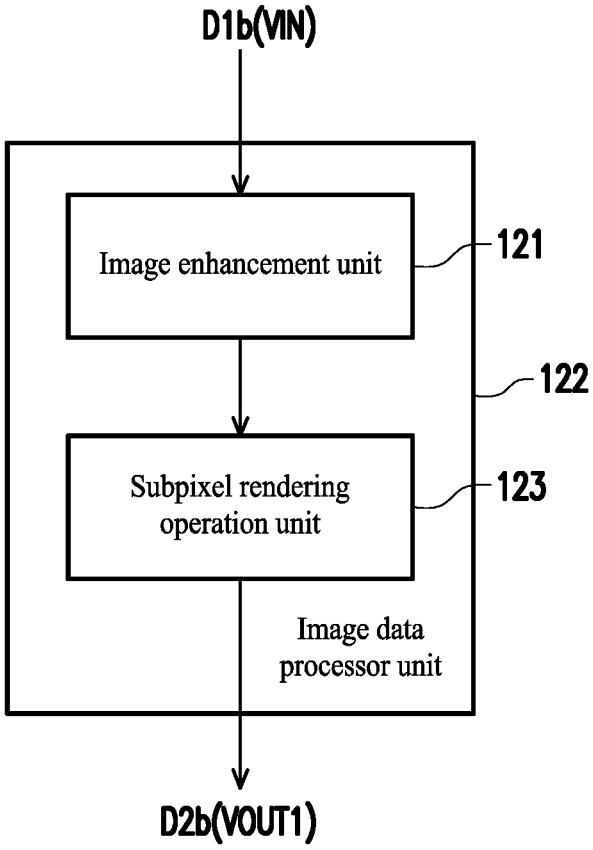
FIG. 3B is a schematic diagram of an image data processor unit in the embodiment of FIG. 3A.

FIG. 3A is a schematic diagram of the display driver in the embodiment of FIG. 1. FIG. 3B is a schematic diagram of an image data processor unit in the embodiment of FIG. 3A. With reference to FIG. 3A and FIG. 3B, the display driver 120 of the present embodiment includes an image data processor unit 122, an image compression unit 124, a storage unit 126, an image decompression unit 128 and a data reconstruction unit 129. The image data processor unit 122, the image compression unit 124, the storage unit 126, the image decompression unit 128 and the data reconstruction unit 129 are disposed in the display driver 120 of the display apparatus 100. In the present embodiment, an image input unit 132 is, for example, an image source outside the display driver 120, which is configured to output a first image data D1*b* to the image data processor unit 122. The first image data D1*b* represents one input frame VIN, which is inputted to the image data processor unit 122. In an embodiment, the display driver 120 is, for example, an integrated display driving chip for driving a small or medium size panel, and the integrated display driving chip includes a timing controller circuit and a source driving circuit. In this case, the image data processor unit 122 is, for example, disposed in the timing controller circuit, and the display apparatus 100 may include an application processor to serve as the image input unit 132. In another embodiment, the display driver 120 includes, for example, a timing controller chip (without being integrated with a data driver chip into one single chip), and the image data processor unit 122 is, for example, disposed in the timing controller chip.

In the present embodiment, the image data processor unit 122 includes an image enhancement unit 121 and a sub-pixel rendering operation unit 123. The image enhancement unit 121 receives the first image data D1*b*. The image enhancement unit 121 is, for example, configured to enhance boundary regions between object and object or between object and background in images so as to bring out the boundary regions so they can be easily determined thereby improving an image quality. The image enhancement unit 121 may also include a related image processing for adjusting image color or luminance. In the present embodiment, the sub-pixel rendering operation unit 123 receives the first image data D1*b* processed by the image enhancement unit 121. The sub-pixel rendering operation unit 123 is configured to perform the sub-pixel rendering operation on the first image data D1*b* (the input frame VIN) to generate a second image data D2*b* (the partial output frame VOUT1). In an embodiment, it is also possible that the sub-pixel rendering operation unit 123 can directly receive the first image data D1*b* from the image input unit 132 without going through the image enhancement unit 121. In other words, the image enhancement unit 121 may be disposed according to actual design requirements, and the image data processor unit 122 may include the image enhancement unit 121 or not.

In the present embodiment and the subsequent embodiments, each sub-pixel data in the first image data D1*b* received by the image data processor unit 122 is a gray level value, whereas a sub-pixel data processed by the sub-pixel rendering operation unit 123 is a luminance value instead of the gray level value. Therefore, the sub-pixel rendering operation unit 123 may also include an operation of converting the sub-pixel in the received first image data D1*b* (or the image data processed by the image enhancement unit 121) from the gray level value into the luminance value so the sub-pixel rendering operation can be performed subsequently. In the present embodiment and the subsequent embodiments, because each sub-pixel data in the second image data D2*b* generated after the sub-pixel rendering operation performed by the sub-pixel rendering operation unit 123 is the luminance value, the sub-pixel rendering operation unit 123 may also include an operation of converting the luminance value into the gray level value followed by outputting the second image data D2*b* with data content being the gray level value. Although the operations of converting the gray level value into the luminance value and converting the luminance value into the gray level value are not shown in the schematic diagram of each subsequent embodiment, person skilled in the art should be able to understand a processed image data type is the gray level value or the luminance value according to each unit block.

In the present embodiment, the sub-pixel rendering operation unit 123 outputs the second image data D2*b* (the partial output frame VOUT1) to the image compression unit 124. The image compression unit 124 is configured to compress the second image data D2*b* to generate a third image data D3*b* (which is an image data generated by compressing the partial output frame VOUT1). Then, the image compression unit 124 outputs the third image data D3*b* to the storage unit 126. In the present embodiment, the storage unit 126 includes, for example, a frame buffer, which is configured to receive and store the third image data D3*b*. Also, the storage unit 126 can at least store two different third image data D3*b* (i.e., two compressed partial output frames VOUT1). The image decompression unit 128 is configured to access each of the third image data D3*b* stored by the storage unit 126, and decompress each of the third image data D3*b* to obtain a corresponding decompressed second image data D2*b*. The data reconstruction unit 129 is configured to reconstruct the multiple decompressed second image data D2*b* (the partial output frames VOUT1) into a fourth image data D4*b* and output the fourth image data D4*b* as the output frame VOUT2 for driving the display panel 110. In the present embodiment, the display driver 120 generates a corresponding data voltage according to the output frame VOUT2 for driving the display panel 110 to display image frames.

In the embodiment of FIG. 3A and FIG. 3B, the sub-pixel rendering operation unit 123 performs the sub-pixel rendering operation on the first image data D1*b* to generate the second image data D2*b*. The second image data D2*b* is compressed to generate the third image data D3*b*. Compared to a data quantity of the first image data D1*b*, the data quantities of the second image data D2*b* and the third image data D3*b* may be reduced. In an embodiment, the image compression unit 124 is used as an image data transmitter, and the storage unit 126 is used as an image data receiver. In this way, a transmission bandwidth between the image compression unit 124 and the storage unit 126 may be reduced, and a storage capacity of the storage unit 126 (the frame buffer) may also be reduced.

Figure 4:
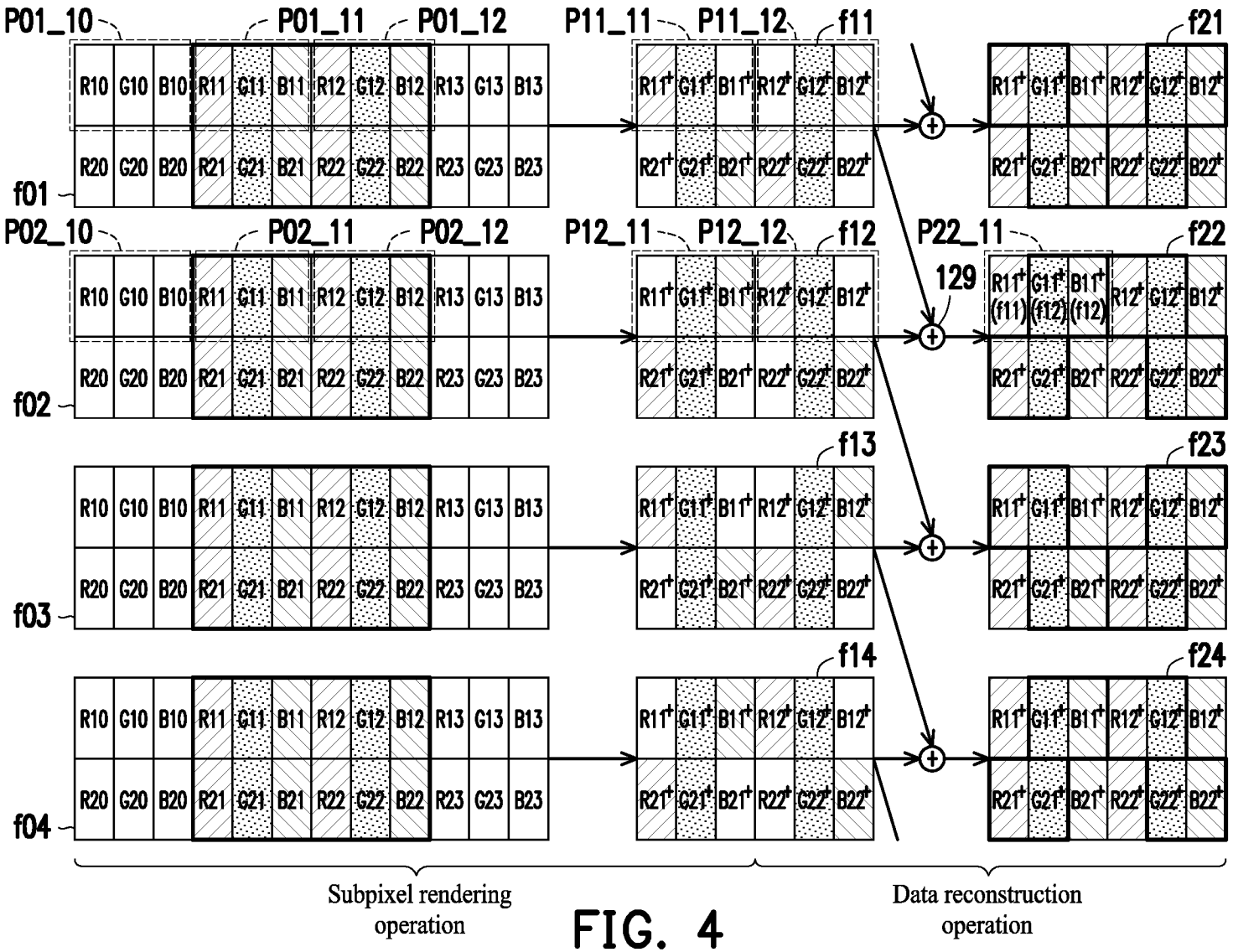
FIG. 4 is a schematic diagram illustrating a sub-pixel rendering operation and a data reconstruction operation in an embodiment of the invention.

FIG. 4 is a schematic diagram illustrating a sub-pixel rendering operation and a data reconstruction operation in an embodiment of the invention. FIG. 4 shows partial pixel data in the input frames, the partial output frames and the output frames for illustrative purposes only, where the sub-pixel data with different colors are represented by different background patterns. Some sub-pixel data in the partial output frames with the background pattern being blank means that the sub-pixel data is not included in the partial output frame. In the present embodiment and the subsequent embodiments, among sub-pixel data marks, R denotes a red sub-pixel data; G denotes a green sub-pixel data; and B denotes a blue sub-pixel data. The sub-pixel data marks are used to represent the sub-pixel data and its data value, such as the luminance value. For instance, in the input frame f01 illustrated in FIG. 4, a pixel data P01_10 includes sub-pixel data R10, G10, and B10; a pixel data P01_1 includes sub-pixel data R11, G11, and B11; and a pixel data P01_12 include sub-pixel data R12, G12, and B12. With reference to FIG. 3A to FIG. 4, in the present embodiment, the input frame VIN in FIG. 3A represents each input frame among input frames f01 to f04 in FIG. 4; the partial output frame VOUT1 in FIG. 3A represents each partial output frame among partial output frames f11 to f14 in FIG. 4; and the output frame VOUT2 represents each output frame among output frames f21 to f24 in FIG. 4.

Specifically, in the present embodiment, the input frames f01 to f04 are sequentially transmitted over time. That is to say, the sub-pixel rendering operation unit 123 sequentially receives the input frames f01 to f04, and the sub-pixel rendering operation unit 123 separately generates the corresponding partial output frames according to each of the input frames. With respect to one pixel in the display panel, each of the partial output frames includes a part, instead of all, of sub-pixel data to be displayed by the pixel.

The pixel data P11_11 of the partial output frame f11 corresponds to one pixel in the display panel, such as a pixel 112A_1 in the display panel of FIG. 2A. In order to generate a red sub-pixel data R11$^+$ to be displayed by the pixel, the sub-pixel rendering operation unit 123 may know which pixel data (and red sub-pixel data therein) in the input frame f01 that the sub-pixel data rendering operation be performed on. In the example of FIG. 4, the sub-pixel rendering operation unit 123 performs the sub-pixel rendering operation on the red sub-pixel data R10 and R11 in the two adjacent pixel data P01_10 and P01_11 in the input frame f01, so as to generate the sub-pixel data R11$^+$ of the pixel data P11_11 in the partial output frame f11. In other words, the red sub-pixel of the pixel 112A_1 in the display panel of FIG. 2A is related to the red sub-pixel R10 and R11 in the input frame f01.

In the present embodiment, the sub-pixel data R11$^+$ of the pixel data P11_11 may be obtained by calculation according to a set of color diffusion ratios $$\left(\frac{1}{2}, \frac{1}{2}\right): R11^+ = \frac{1}{2}R10 + \frac{1}{2}R11.$$

On the other hand, each pixel in each partial output frame includes the green sub-pixel data, and a sub-pixel data G11$^+$ may be obtained by calculation based on the following equation: G11$^+$=G11. In other words, in the embodiment of FIG. 4, the green sub-pixel data in each partial output frame may be generated without going through the sub-pixel data rendering operation, but equal to the corresponding green sub-pixel data in the corresponding input frame. In the present embodiment, the set of color diffusion ratios is merely an example instead of a limitation to the invention.

Similarly, a pixel data P11_12 of the partial output frame f11 corresponds to one pixel in the display panel, such as a pixel 112A_2 in the display panel of FIG. 2A. The sub-pixel rendering operation unit 123 performs the sub-pixel data rendering operation on the blue sub-pixel data B11 and B12 in the two adjacent pixel data P01_11 and P01_12 in the input frame f01 according to the set of color diffusion ratios (1/2,1/2), so as to generate a sub-pixel data B12' of the pixel data P11_12 in the partial output frame f11; the sub-pixel data G12' is equal to the sub-pixel data G12 in the pixel data P01_12 in the input frame f01.

In view of the above, it can be known that, the pixel data P11_11 in the partial output frame f11 correspondingly generated according to the input frame f01 includes the sub-pixel data R11$^+$ and G11$^+$ but does not include the sub-pixel data B11$^+$ (so B11$^+$ is marked with blank background pattern in FIG. 4). In other words, with respect to the pixel corresponding to the pixel data P11_11 in the display panel, the partial output frame f11 provides the pixel data R11$^+$ and G11$^+$ to be displayed by the pixel without providing B11$^+$. Similarly, the pixel data P11_12 in the partial output frame f11 includes the sub-pixel data G12$^+$ and B12$^+$ but does not include the sub-pixel data R12$^+$. In other words, with respect to the pixel corresponding to the pixel data P11_12 in the display panel, the partial output frame f11 provides the pixel data G12$^+$ and B12$^+$ to be displayed by the pixel without providing the sub-pixel data R12$^+$. In the present embodiment, for each pixel on the display panel, the partial output frame f11 does not provide all of the sub-pixel data corresponding to the respective pixel. For the sub-pixels those sub-pixel data are not provided by the partial output frame f11, the sub-pixel data may be provided by a partial output frame previous to the partial output frame f11. Therefore, the data reconstruction unit 129 needs to reconstruct the current partial output frame with a part of data in the previous partial output frame to generate the output frame VOUT2, and description regarding the same will be provided below.

As another example, in the present embodiment, a pixel data P02_10 of the input frame f02 includes sub-pixel data R10, G10 and B10; a pixel data P02_11 includes the sub-pixel data R11, G11, and B11; and a pixel data P02_12 include the sub-pixel data R12, G12, and B12. A pixel data P12_11 of the partial output frame f12 corresponds to one pixel in the display panel, such as the pixel 112A_1 in the display panel of FIG. 2A. In order to generate a blue sub-pixel data B11$^+$ to be displayed the pixel, the sub-pixel rendering operation unit 123 may know which pixel data (and blue sub-pixel data therein) in the input frame f02 that the sub-pixel data rendering operation is performed on. In the example of FIG. 4, the sub-pixel rendering operation unit 123 performs the sub-pixel rendering operation on the blue sub-pixel data B11 and B12 in the two adjacent pixel data P01_11 and P01_12 in the input frame f02, so as to generate the sub-pixel data B11$^+$ of the pixel data P12_11 in the partial output frame f12. In other words, the blue sub-pixel of the pixel 112A_1 in the display panel of FIG. 2A is related to the blue sub-pixel B11 and B12 in the input frame f02. In the present embodiment, the sub-pixel data B11$^+$ of the pixel data P12_11 may be obtained by calculation according to the set of color diffusion ratios $$\left(\frac{1}{2}, \frac{1}{2}\right): B11^+ = \frac{1}{2}B10 + \frac{1}{2}B11,$$

and the sub-pixel data G11$^+$ may be obtained by calculation based on the following equation: G11$^+$=G11.

In view of the above, it can be known that, the pixel data P12_11 in the partial output frame f12 correspondingly generated according to the input frame f02 includes the sub-pixel data G11$^+$ and B11$^+$ but does not include the sub-pixel data R11$^+$. In other words, with respect to the pixel corresponding to the pixel data P12_11 in the display panel, the partial output frame f12 provides the pixel data G11$^+$ and B11$^+$ to be displayed by the pixel without providing the sub-pixel data R11$^+$. Similarly, a pixel data P12_12 in the partial output frame f12 includes the sub-pixel data R12$^+$ and G12$^+$ but does not include the sub-pixel data B12$^+$. In other words, with respect to the pixel corresponding to the pixel data P12_12 in the display panel, the partial output frame f12 provides the pixel data R12$^+$ and G12$^+$ to be displayed by the pixel without providing the sub-pixel data B12$^+$.

It is also noted that, according to the present embodiment, a color set (G, B) of the sub-pixel data included by the pixel data P12_11 is different from a color set (R, G) of the sub-pixel data included by the pixel data P11_11 corresponding to the same pixel (e.g., the pixel 112A_1 of FIG. 2A) in the previous partial output frame f11. Similarly, a color set (R, G) of the sub-pixel data included by the pixel data P12_12 is different from a color set (G, B) of the sub-pixel data included by the pixel data P11_12 corresponding to the same pixel (e.g., the pixel 112A_2 of FIG. 2A) in the previous partial output frame f11. In the present embodiment, the partial output frame f12 does not provide all of the sub-pixel data corresponding to the pixel. For the sub-pixels those sub-pixel data are not provided by the partial output frame f12, the sub-pixel data may be provided by the partial output frame f11 which is previous to the partial output frame f12, and yet, needed to be reconstructed by the data reconstruction unit 129.

In the present embodiment, the data reconstruction unit 129 reconstructs the partial output frames f11 and f12 into an output frame f22 and outputs the output frame f22 for driving the display panel 110A of FIG. 2A, for example. For instance, the data reconstruction unit 129 reconstructs, for example, the pixel data P11_11 (including the sub-pixel data R11$^+$ and G11$^+$) in the partial output frame f11 and P12_11 (including the sub-pixel data G11$^+$ and B11$^+$) in the partial output frame f12 into a pixel data P22_11 of the output frame f22, which is used to drive the pixel 112A_1 in the display panel 110A of FIG. 2A, for example. The sub-pixel data R11$^+$ of the pixel data P22_11 is, for example, selected from the pixel data P11_11 of the partial output frame f11 (because the pixel data P12_11 of the partial output frame f12 does not include the red sub-pixel data) and marked by R11$^+$(f11). The sub-pixel data G11$^+$ and B11$^+$ in the pixel data P22_11 are, for example, selected from the sub-pixel data G11$^+$ and B11$^+$ of the pixel data P12_11 of the partial output frame f12 respectively (where the pixel data P12_11 includes the sub-pixel data G11 and B11$^+$) and marked by G11$^+$(f12) and B11$^+$(f12). The display driver 120 generates a plurality of corresponding data voltages according to all of the sub-pixel data corresponding to the pixel 112A_1 in the output frame f22 for driving all of the sub-pixels (i.e., the three colors of red, green and blue) in the pixel 112A_1.

Each of the sub-pixel data in the partial output frame f11 illustrated in FIG. 4 may be obtained by calculation based on the followings:

$$R11^+ = \frac{1}{2}R10 + \frac{1}{2}R11;$$

G11$^+$=G11; G12$^+$=G12;

$$B12^+ = \frac{1}{2}B12 + \frac{1}{2}B11;$$

G21$^+$=G21;

$$B21^+ = \frac{1}{2}B21 + \frac{1}{2}B20;\ R22^+ = \frac{1}{2}R22 + \frac{1}{2}R21;$$

and G22$^+$=G22. Each of the sub-pixel data in the partial output frame f12 illustrated in FIG. 4 may be obtained by calculation based on the followings: G11$^+$=G11;

$$B11^+ = \frac{1}{2}B10 + \frac{1}{2}B11;\ R12^+ = \frac{1}{2}R12 + \frac{1}{2}R11;$$

G12$^+$=G12;

$$R21^+ = \frac{1}{2}R21 + \frac{1}{2}R20;$$

G21$^+$=G21; G22$^+$=G22; and $$B22^+ = \frac{1}{2}B22 + \frac{1}{2}B21.$$

Each of the sub-pixel data in the partial output frame f13 illustrated in FIG. 4 may be obtained according to the calculation for the partial output frame f11, each of the sub-pixel data in the partial output frame f14 illustrated in FIG. 4 may be obtained according to the calculation for the partial output frame f12, and so forth.

In the embodiment of FIG. 4, each two input frames are treated as one cycle. For instance, the input frames f01 and f02 are included in one cycle, the input frames f02 and f03 are included in another cycle, and the rest of the cycles may be derived by analogy. The data reconstruction unit 129 generates one corresponding output frame by accordingly reconstructing the partial output frames in each of the cycles. In the present embodiment, the data updating will be completed in one cycle for the sub-pixels of all colors. For example, although the sub-pixel data B11$^+$ not being updated in the output frame f21 adopts the sub-pixel data B11$^+$ of an output frame (not shown) previous to the output frame f21, which is equal to B11$^+$ in a partial output frame previous to the partial output frame f11, the latest sub-pixel data B11$^+$ will be included in the output frame f22; similarly, although the sub-pixel data R11$^+$ not being updated in the output frame f22 adopts the sub-pixel data R11$^+$ of the output frame f21, which is equal to R11$^+$ in the partial output frame f11, the latest sub-pixel data R11$^+$, which is equal to the sub-pixel data R11$^+$ in the partial output frame f13, will be included in the output frame f23. A number of the input frames included in each cycle is not particularly limited in the invention. In an embodiment, it is also possible that each three input frames are treated as one cycle.

Figure 5A:
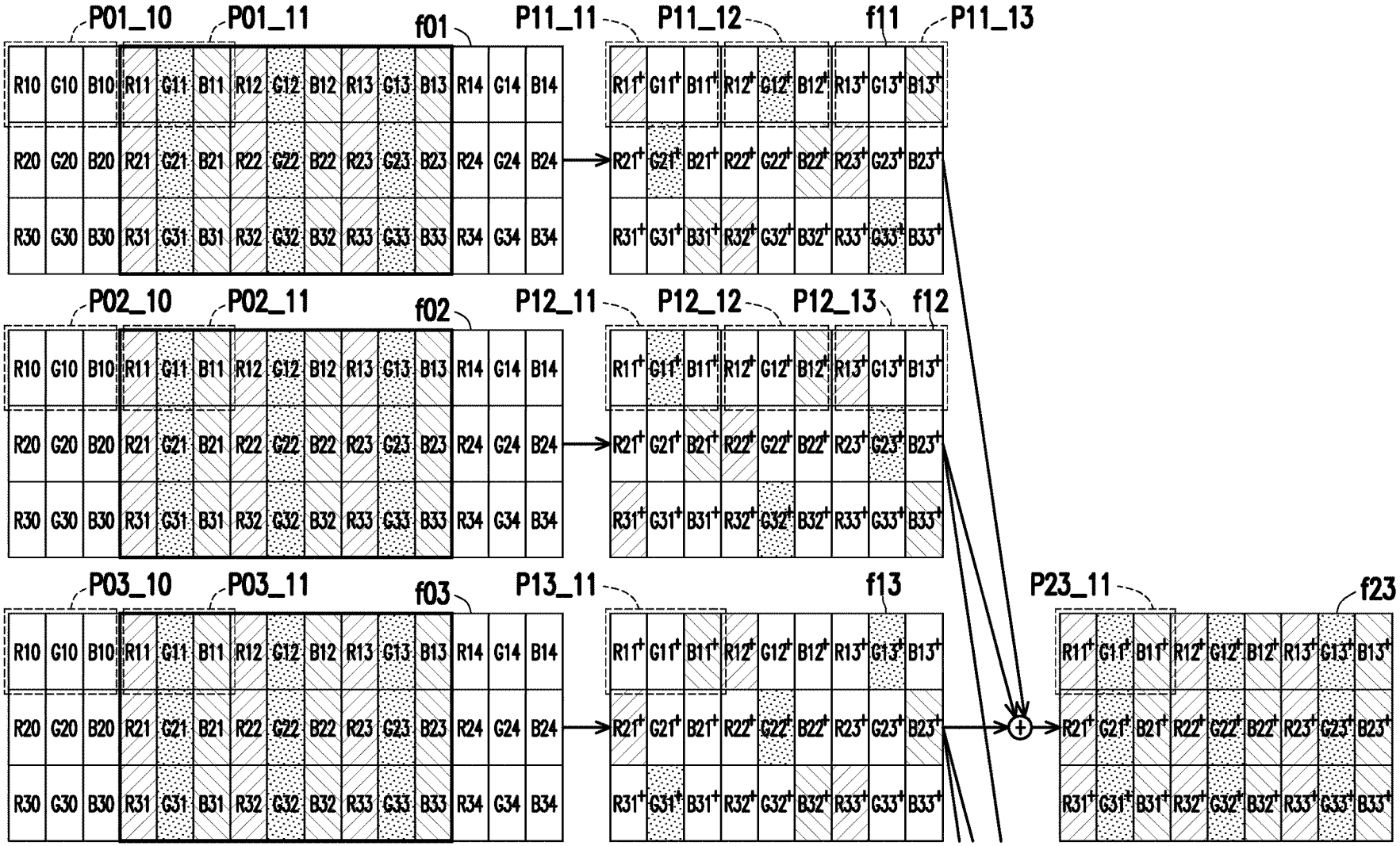
FIG. 5A and FIG. 5B are schematic diagrams illustrating a sub-pixel rendering operation and a data reconstruction operation in another embodiment of the invention.
Figure 5B:
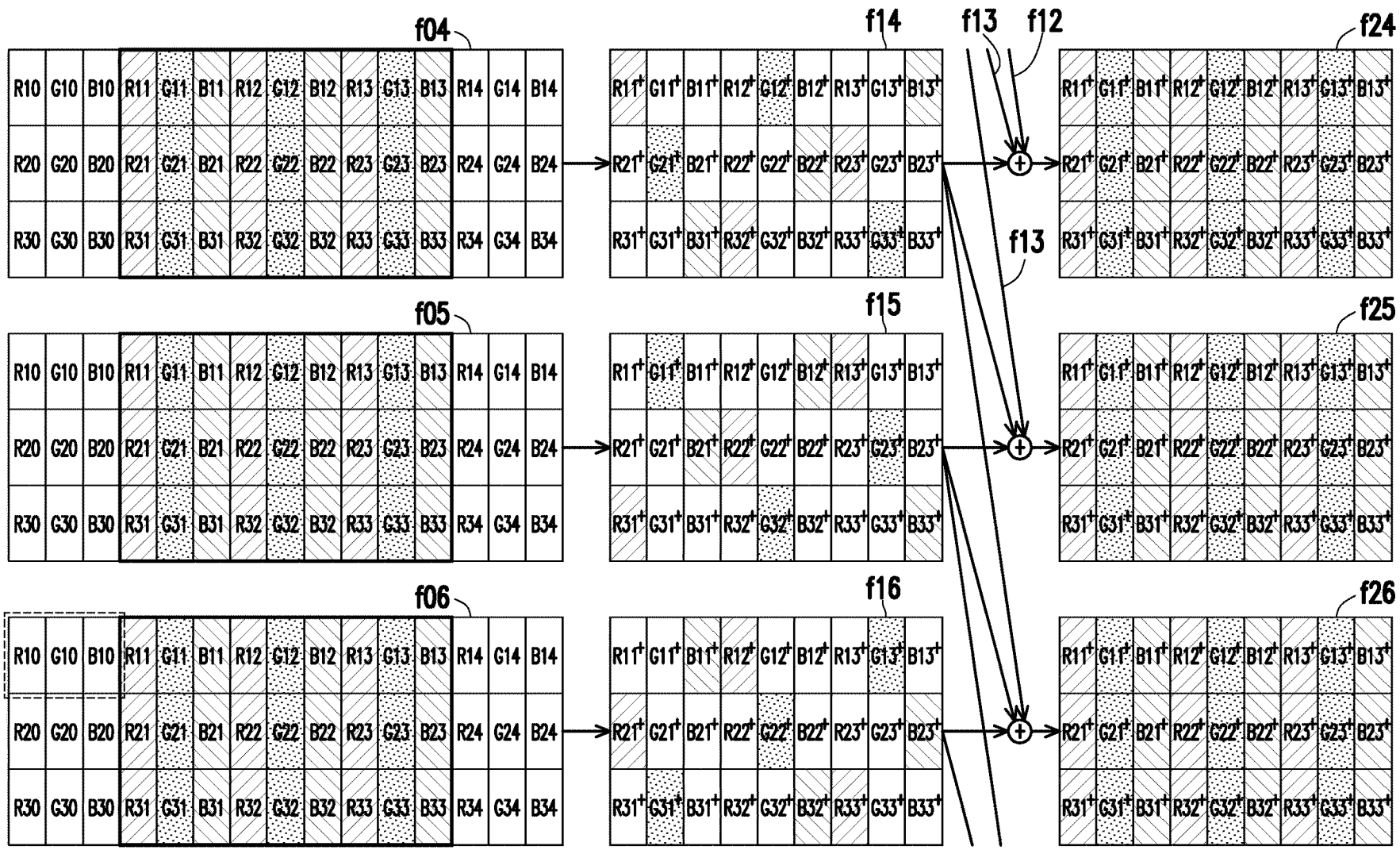

FIG. 5A and FIG. 5B are schematic diagrams illustrating a sub-pixel rendering operation and a data reconstruction operation in another embodiment of the invention. With reference to FIG. 5A and FIG. 5B, in the present embodiment, the input frame VIN represents each input frame among input frames f01 to f06; the partial output frame VOUT1 represents each partial output frame among partial output frames f11 to f16; and the output frame VOUT2 represents each output frame among output frames f23 to f26 in FIG. 4. In the present embodiment, each three input frames are treated as one cycle. For instance, the input frames f01, f02 and f03 are included in one cycle, the input frames f02, f03 and f04 are included in another cycle, and the rest of the cycles may be derived by analogy. The sub-pixel rendering operation unit 123 sequentially receives the input frames f01 to f06, and the sub-pixel rendering operation unit 123 generates the corresponding partial output frame according to each of the input frames. With respect to one pixel in the display panel, each of the partial output frames includes a part, instead of all, of sub-pixel data to be displayed by the pixel.

As shown in FIG. 5A and FIG. 5B, the pixel data P11_11 in the partial output frame f11 correspondingly generated according to the input frame f01 includes the sub-pixel data R11$^+$ but does not include the sub-pixel data G11$^+$ and B11$^+$ (so G11$^+$ and B11$^+$ are marked with blank background pattern in FIG. 5A). In other words, with respect to the pixel corresponding to the pixel data P11_11 in the display panel, the partial output frame f11 only provides the pixel data R11$^+$ to be displayed by the pixel without providing G11$^+$ and B11$^+$. Similarly, the pixel data P11_12 in the partial output frame f11 includes the sub-pixel data G12$^+$ but does not include the sub-pixel data R12$^+$ and B12$^+$. Also, the pixel data P11_13 in the partial output frame f11 includes the sub-pixel data B13$^+$ but does not include the sub-pixel data R13$^+$ and G13$^+$. In other words, according to the embodiment of FIG. 5A and FIG. 5B, in the same partial output frame, colors of the sub-pixel data included by different adjacent pixel data are different.

Similarly, with respect to the pixel corresponding to the pixel data P12_11 in the display panel, the partial output frame f12 only provides the pixel data G11$^+$ to be displayed by the pixel without providing the sub-pixel data B11$^+$ and R11$^+$. Similarly, with respect to the pixel corresponding to the pixel data P12_12 in the display panel, the partial output frame f12 only provides the pixel data B12$^+$ to be displayed by the pixel without providing the sub-pixel data R12$^+$ and G12$^+$. Similarly, with respect to the pixel corresponding to the pixel data P12_13 in the display panel, the partial output frame f12 only provides the pixel data R13$^+$ to be displayed by the pixel without providing the sub-pixel data G13$^+$ and B13$^+$. In short, in the present embodiment, with respect to each pixel on the display panel, each of the partial output frames does not provide all of the sub-pixel data corresponding to the pixel. Therefore, the data reconstruction unit 129 needs to reconstruct the current partial output frame with the previous two partial output frames in order to generate the output frame VOUT2.

Specifically, in the present embodiment, the sub-pixel data R11$^+$ of the pixel data P11_11 of the partial output frame f11, the sub-pixel data G11$^+$ of the pixel data P12_11 of the partial output frame f12 and the sub-pixel data B11$^+$ of the pixel data P13_11 of the partial output frame f13 are reconstructed into the sub-pixel data R11$^+$, G11$^+$ and B11$^+$ of a pixel data P23_11 of the output frame f23, and displayed by the sub-pixels in three colors (red, green and blue) of the pixel 112A_1 in the display panel 110A of FIG. 2A, respectively.

In the present embodiment, the sub-pixel rendering operation unit 123 performs the sub-pixel rendering operation on the sub-pixel data R10, R11 and R12 of the input frame f01 to generate the sub-pixel R11$^+$ of the pixel data P11_11 of the partial output frame f11. The sub-pixel data R10, R11 and R12 respectively correspond to a plurality of different pixels 112A_0, 112A_1 and 112A_2 on a same row in the display panel 110A. In the present embodiment, the sub-pixel data R11$^+$ of the partial output frame f11 may be obtained by calculation according to a set of color diffusion ratios $$\left(\frac{1}{3}, \frac{1}{3}, \frac{1}{3}\right): R11^+ = \frac{1}{3}R10 + \frac{1}{3}R11 + \frac{1}{3}R12.$$

Similarly, the sub-pixel rendering operation unit 123 performs the sub-pixel rendering operation on the sub-pixel data G10, G11 and G12 of the input frame f02 to generate the sub-pixel G11$^+$ of the pixel data P12_11 of the partial output frame f12. The sub-pixel data G10, G11 and G12 respectively correspond to the different pixels 112A_0, 112A_1 and 112A_2 on the same row in the display panel 110A. In the present embodiment, the sub-pixel data G11$^+$ of the partial output frame f12 may be obtained by calculation according to the set of color diffusion ratios (1/3,1/3,1/3):

$$\left(\frac{1}{3}, \frac{1}{3}, \frac{1}{3}\right): G11^+ = \frac{1}{3}G10 + \frac{1}{3}G11 + \frac{1}{3}G12.$$

Similarly, the sub-pixel data B11$^+$ of the partial output frame f13 may be obtained by calculation according to the set of color diffusion ratios (1/3,1/3,1/3):

$$\left(\frac{1}{3}, \frac{1}{3}, \frac{1}{3}\right): B11^+ = \frac{1}{3}B10 + \frac{1}{3}B11 + \frac{1}{3}B12.$$

In the present embodiment, the sub-pixel data of each color in the partial output frames may all be obtained by calculation with the same set of color diffusion ratios $$\left(\frac{1}{3}, \frac{1}{3}, \frac{1}{3}\right).$$

Accordingly, in the present embodiment, the data reconstruction unit 129 can reconstruct the partial output frames f11, f12 and f13 into the output frame f23 and output the output frame f23 for driving the display panel 110A. For instance, the data reconstruction unit 129 reconstructs the pixel data P11_11, P12_11 and P13_11 into the pixel data P23_11 of the output frame f23, for example. The sub-pixel data R11$^+$ in the pixel data P23_11 is, for example, selected from the pixel data P11_11, which simply includes the sub-pixel data R11$^+$. The sub-pixel data G11$^+$ in the pixel data P23_11 is, for example, selected from the pixel data P12_11, which simply includes the sub-pixel data G11. The sub-pixel data B11$^+$ in the pixel data P23_11 is, for example, selected from the pixel data P13_11, which simply includes the sub-pixel data B11$^+$. In the present embodiment, with respect to the pixel 112A_1 in the display panel 110A, the display driver 120 generates a plurality of corresponding data voltages according to all of the sub-pixel data R11$^+$, G11$^+$ and B11$^+$ corresponding to the pixel 112A_1 in the output frame f23 for driving all of the sub-pixels (i.e., the three colors of red, green and blue) in the pixel 112A_1. In the present embodiment, the data reconstruction unit 129 generates one corresponding output frame by accordingly reconstructing three consecutive partial output frames in each of the cycles. Data update will be completed in one cycle for the sub-pixels of all colors in the display panel.

To realize each of the partial output frames illustrated in FIGS. 4A and 4B or FIGS. 5A and 5B, the sub-pixel rendering operation unit 123 can determine which color of the sub-pixel should be included in one pixel data in the currently generated partial output frame by counting results from different counters. For example, the image data processor unit 122 may include a frame counter, a display line counter and a pixel counter. The frame counter is used to count the ordinal number corresponding to the current output frame. The display line counter is used to count the ordinal number corresponding to the display line which pixel data are currently generated. The pixel counter is used to count the ordinal number corresponding to pixel data currently generated. In the embodiment of FIGS. 5A and 5B, the pixel rendering operation unit 123 can determine which color of the sub-pixel should be included in the pixel data to be currently generated according to a remainder of count values from the counters divided by three.

Figure 6:
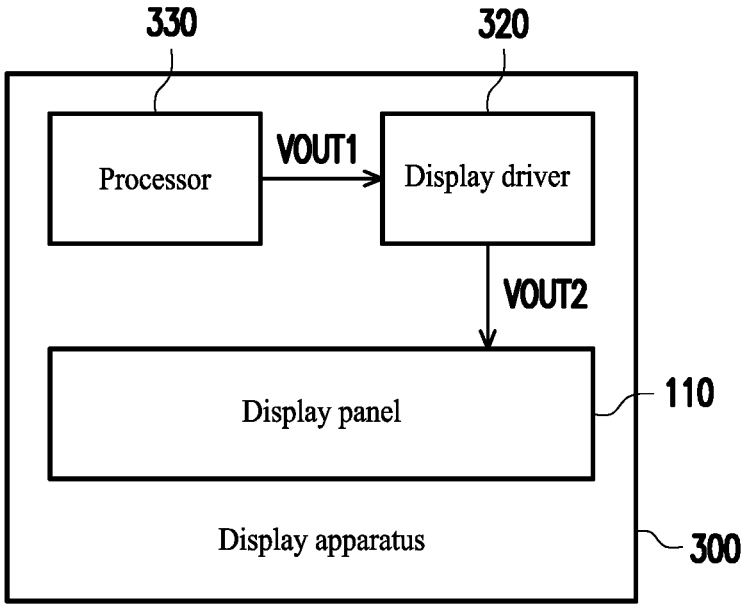
FIG. 6 is a schematic diagram illustrating a display apparatus in another embodiment of the invention.
Figure 7:
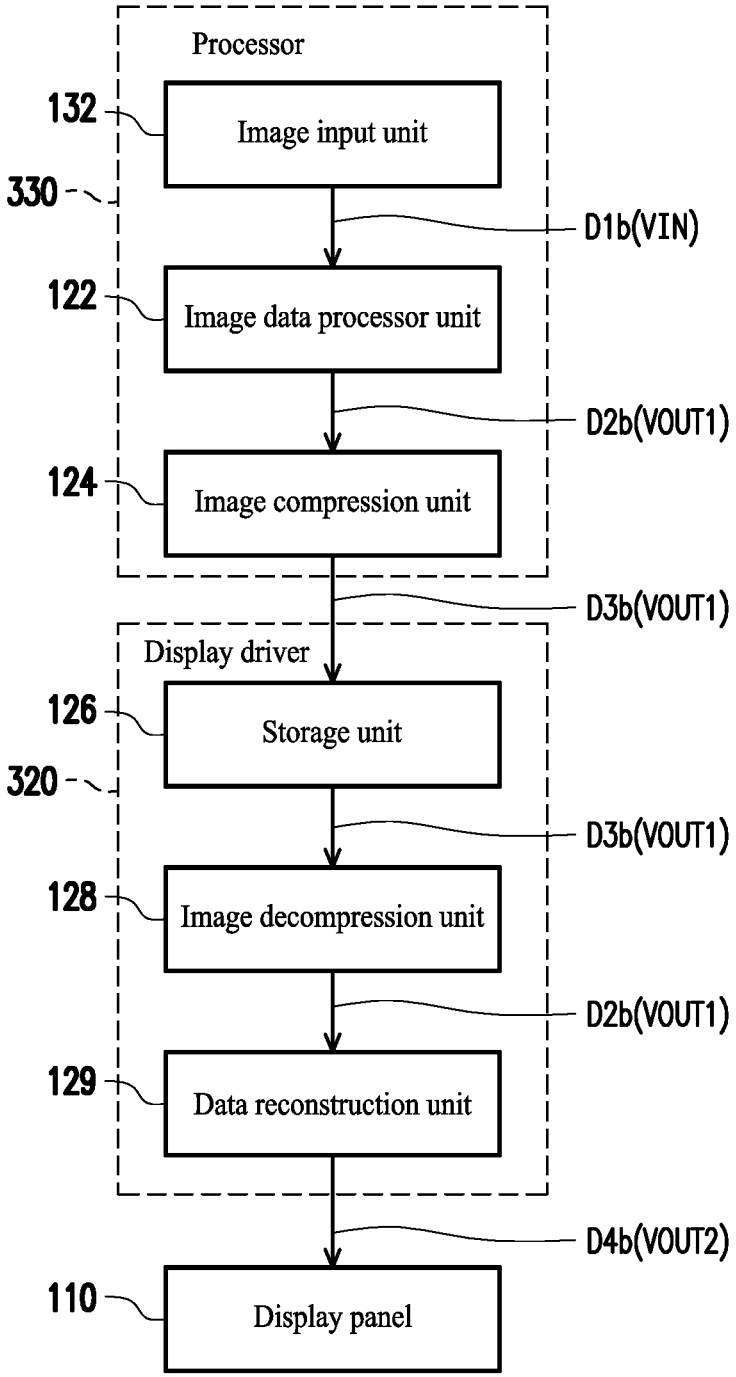
FIG. 7 is a schematic diagram of a display driver and a processor in the embodiment of FIG. 6.

FIG. 6 is a schematic diagram illustrating a display apparatus according to another embodiment of the invention. FIG. 7 is a schematic diagram of a display driver and a processor in the embodiment of FIG. 6. With reference to FIG. 6 and FIG. 7, a display apparatus 300 of the present embodiment includes the display panel 110, a display driver 320 and a processor 330. In an embodiment, the processor 330 is, for example, an application processor (AP). In the present embodiment, the display apparatus 300 is, for example, an electronic apparatus having a display panel, such a cell phone, a tablet computer or a camera.

In the present embodiment, the processor 330 may be regarded as an image processing apparatus, and the image input unit 132, the image data processor unit 122 and the image compression unit 124 are disposed in the processor 330. The storage unit 126, the image decompression unit 128 and the data reconstruction unit 129 are disposed in the display driver 320. The display driver 320 is configured to receive the third image data D3*b* from the processor 330 and drive the display panel 110 according to the fourth image data D4*b* (the output frame VOUT2). In the present embodiment, the image data processor unit 122 performs the sub-pixel rendering operation on the first image data D1*b* (the input frame VIN) to generate a second image data D2*b* (the partial output frame VOUT1). The second image data D2*b* is compressed to generate the third image data D3*b*. Compared to a data quantity of the first image data D1*b*, the data quantities of the second image data D2*b* and the third image data D3*b* may be reduced. In the present embodiment, the processor 330 is used as an image data transmitter, and the display driver 320 is used as an image data receiver. In this way, a transmission bandwidth between the processor 330 and the display driver 320 may be reduced, and a storage capacity of the storage unit 126 (the frame buffer) of the display driver 320 may also be reduced.

In addition, sufficient teaching, suggestion, and implementation regarding an operation method of the image processing apparatus and the method for generating the display data of the display panel of the present embodiment the invention may be obtained from the foregoing embodiments of FIG. 1 to FIG. 5B, and thus related descriptions thereof are not repeated hereinafter.

Figure 8:
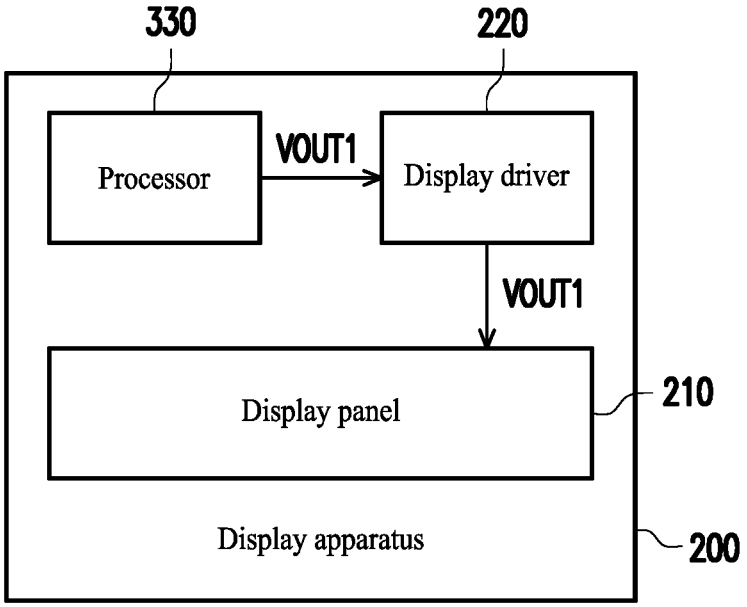
FIG. 8 is a schematic diagram illustrating a display apparatus in an embodiment of the invention.
Figure 9:
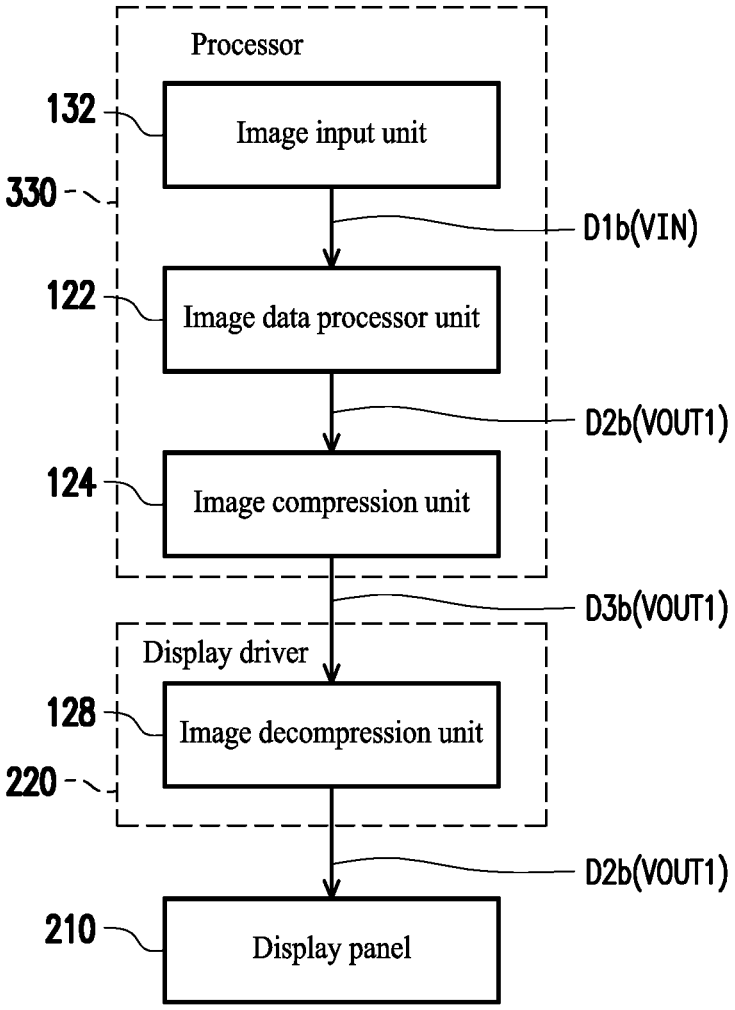
FIG. 9 is a schematic diagram of a display driver and a processor in the embodiment of FIG. 8.

FIG. 8 is a schematic diagram illustrating a display apparatus in an embodiment of the invention. FIG. 9 is a schematic diagram of a display driver and a processor in the embodiment of FIG. 8. With reference to FIG. 8 and FIG. 9, a display apparatus 200 of the present embodiment includes a display panel 210, a display driver 220 and the processor 330. In the present embodiment, the display apparatus 200 is, for example, an electronic apparatus having a display function, such a cell phone, a tablet computer or a camera.

In the present embodiment, the processor 330 includes the image input unit 132, the image data processor unit 122 and the image compression unit 124. The display driver 220 includes the image decompression unit 128. The display driver 220 is configured to receive the third image data D3*b* from the processor 330, and drive the display panel 210 according to the decompressed second image data D2*b*. In the present embodiment, the image data processor unit 122 performs the sub-pixel rendering operation on the first image data D1*b* to generate the second image data D2*b*. The second image data D2*b* is compressed to generate the third image data D3*b*. Compared to a data quantity of the first image data D1*b*, the data quantities of the second image data D2*b* and the third image data D3*b* may be reduced. In the present embodiment, the processor 330 is used as an image data transmitter, and the display driver 220 is used as an image data receiver. In this way, a transmission bandwidth between the processor 330 and the display driver 220 may be reduced.

In the present embodiment, the second image data D2*b* (the partial output frame VOUT1) outputted by the image data processor unit 122 may include one of the partial output frames f11 to f16 as shown in FIG. 4, and the image data processor unit 122 uses each two output frames as one cycle to update all of the sub-pixel data. Alternatively, in another embodiment, the second image data D2*b* (the partial output frame VOUT1) outputted by the image data processor unit 122 may include one of the partial output frames f11 to f16 as shown in FIG. 5A and FIG. 5B, and the image data processor unit 122 uses each three output frames as one cycle to update all of the sub-pixel data.

In the present embodiment, after compressing the second image data D2*b*, the image compression unit 124 generates the third image data D3*b* to be transmitted to the image decompression unit 128. Subsequently, after decompressing the third image data D3*b*, the image decompression unit 128 generates the second image data D2*b*, which is used to drive the display panel 210. In the present embodiment, it is not required to have the second image data D2*b* (the partial output frame VOUT1) outputted by the image data processor unit 122 reconstructed but simply converted into data voltages by the display driver 220 for driving the display panel 210. For instance, the display panel 210 may be driven according to each of the partial output frames illustrated in FIGS. 4A and 4B without going through reconstruction.

Figure 10A:
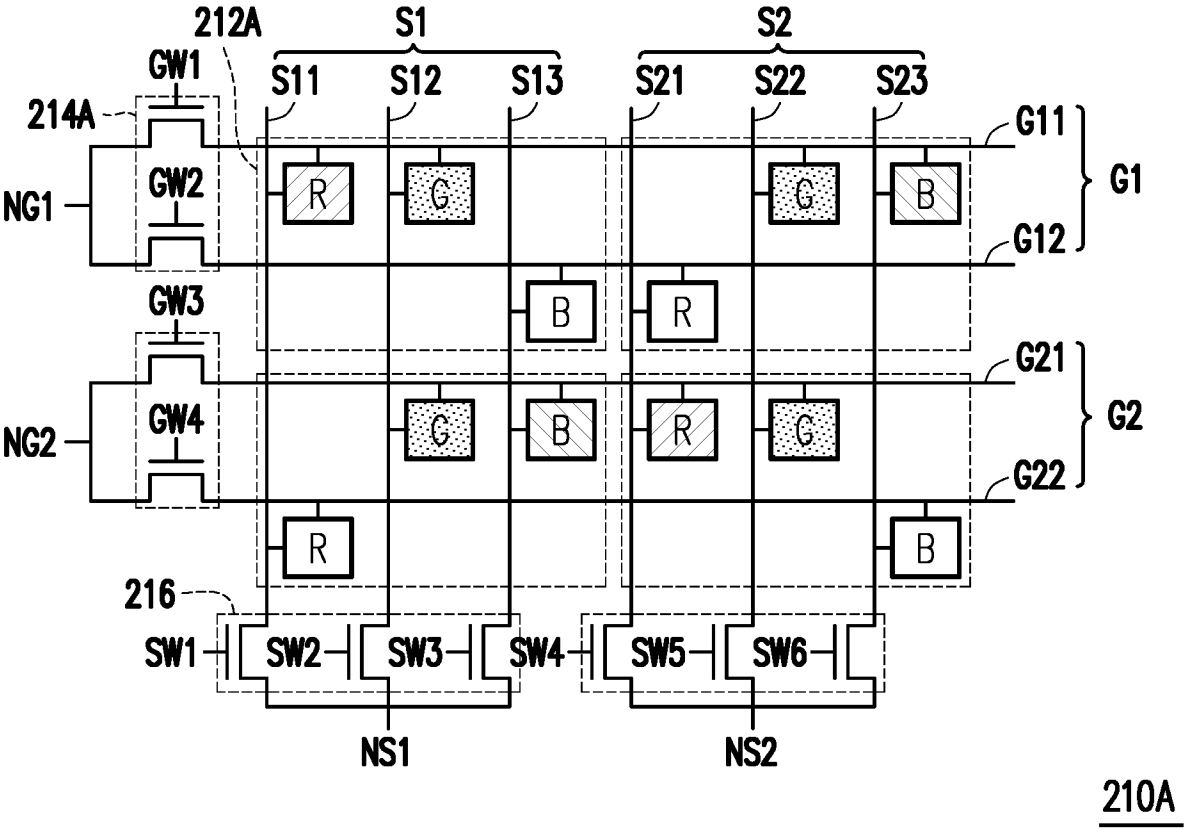
FIG. 10A and FIG. 10B are schematic diagrams illustrating a display panel and image data being written into pixels on the display panel in an embodiment of the invention.
Figure 10B:
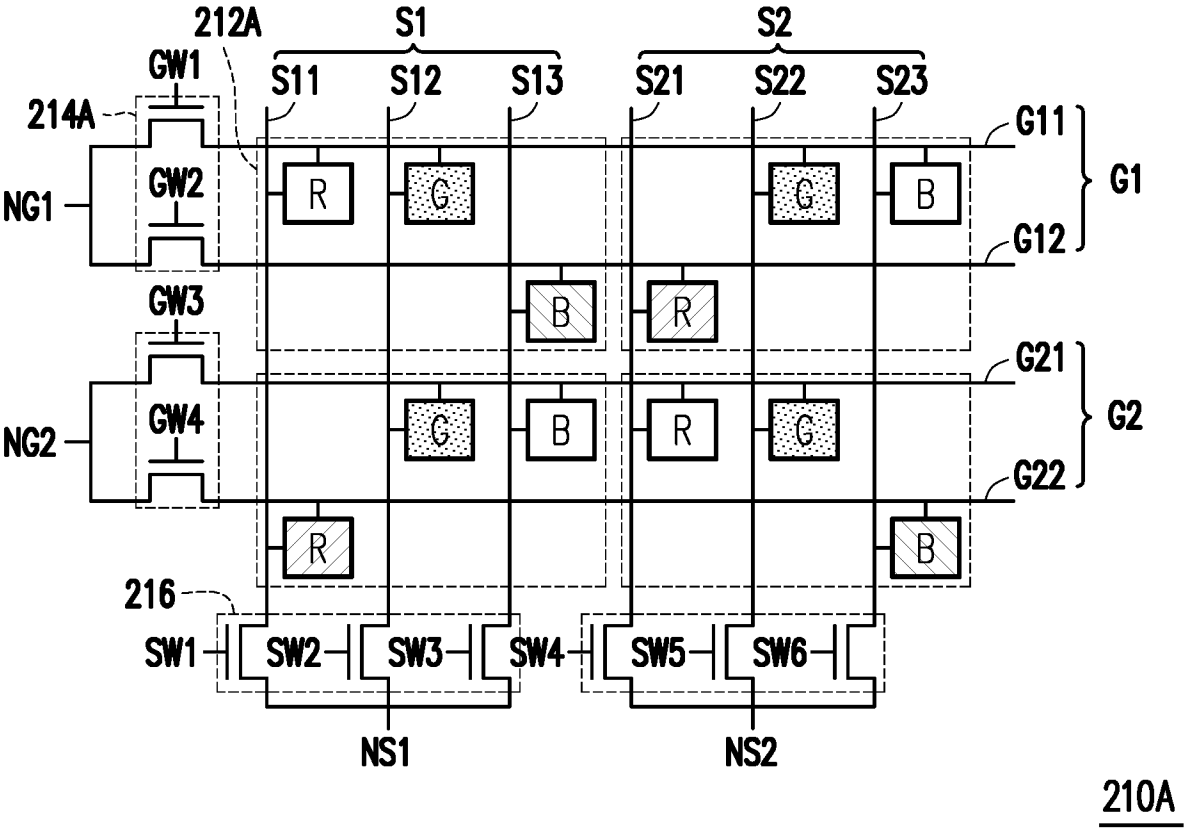
Figure 11:
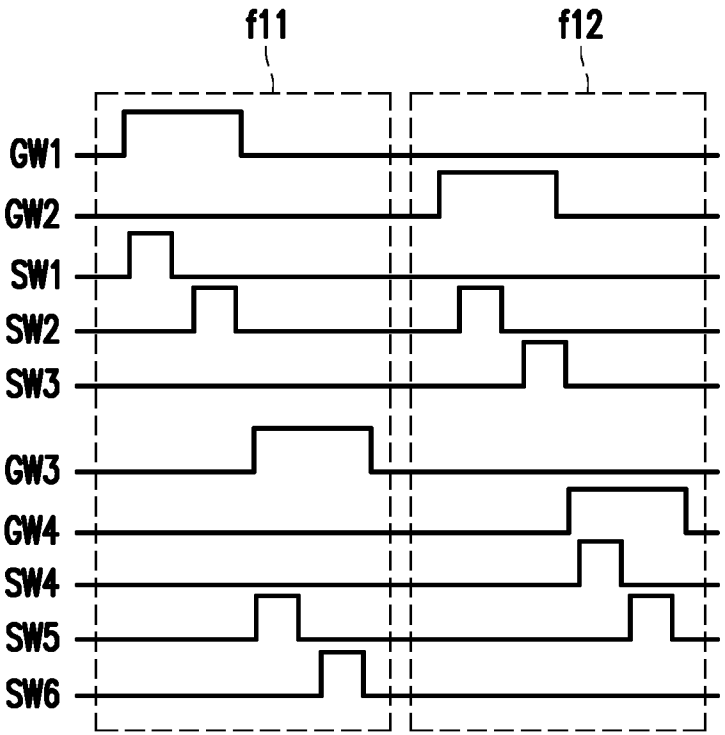
FIG. 11 is a schematic diagram illustrating control signals of the display panel in the embodiment of FIG. 10A and FIG. 10B.

FIG. 10A and FIG. 10B are schematic diagrams illustrating a display panel and image data being written into pixels on the display panel in an embodiment of the invention. A display panel 210A is an embodiment of the display panel 210 of FIG. 9. FIG. 11 is a schematic diagram illustrating control signals of the display panel in the embodiment of FIG. 10A and FIG. 10B. A timing sequence illustrated in FIG. 11 may be used to control the two consecutive partial output frames f11 and f12 to be displayed on the display panel 210A. With reference to FIG. 10A to FIG. 11, in the present embodiment, the display panel 210A includes a plurality of pixel rows, a plurality of data line groups S1 and S2, a plurality of data signal switching units 216, a plurality of scan line groups G1 and G2 and a plurality of scan signal switching units 214A. Each of the data signal switching unit 216 and the scan signal switching unit 214A includes a plurality of switch elements. FIG. 11 illustrates a plurality of control signals GW1 to GW4 and SW1 to SW6. When there is no data updating (i.e., no data voltage outputted), sub-pixels of the display panel 210A can last for a while with the data voltages other than not displaying at all.

In the present embodiment, the pixel row includes a plurality of pixels 212A. Each pixel includes three sub-pixels R, G and B. The data line group S1 includes three data lines S11, S12 and S13 coupled to the three pixels R, G and B, respectively. The data signal switching unit 216 is configured to couple a data signal input terminal (NS1, NS2) to one data line in the data line group. The scan line group G1 includes two scan lines G11 and G12. The scan line G11 is coupled to two sub-pixels in each pixel. The scan line G12 is coupled to the other one sub-pixel in each pixel. The scan signal switching unit 214A is configured to couple a scan signal input terminal (NG1, NG2) to one scan line in the scan line group. In the present embodiment, each scan line is coupled to at least one sub-pixel in each of the pixels of the pixel row, and a number of sub-pixels coupled by each scan line is less than a number of sub-pixels included by the pixel, as shown in FIG. 10A and FIG. 10B.

Further, a coupling relation of the sub-pixels with respect to the three data lines S21, S22 and S23 of the data line group S2 and the scan lines G11 and G12 of the scan line group G2 may be derived by analogy with reference the data line group S1, the scan line group G1 depicted in FIG. 10A and FIG. 10B. In the present embodiment, each element, the coupling relation among the elements and the number of the signals are merely examples rather than limitations to the invention.

In detail, FIG. 10A illustrates the situation where the display driver 220 writes the partial output frame f11 of FIG. 4 into the pixels in the display panel 210A. FIG. 10B illustrates the situation where the display driver 220 writes the partial output frame f12 of FIG. 4 into the pixels in the display panel 210A. In FIG. 11, dotted boxes marked by f11 and f12 represent waveform diagrams of the control signal of each switch element when the partial output frames f11 and f12 are written into the display panel 210A, respectively. The control signal at high level can control the corresponding switch element to be turned on so the sub-pixel data can be written into the corresponding sub-pixel. The operating method for the rest of the partial output frames in FIG. 4 to be written into the display panel may be derived from the above. In the present embodiment, it is not required to have the partial output frame VOUT1 outputted by the image data processor unit 122 reconstructed but simply converted into data voltages by the display driver 220 for driving the display panel 210A. The sub-pixel marked with the background pattern in FIGS. 10A and 10B indicates that the current partial output frame (f11 or f12) includes the corresponding sub-pixel data, whereas the sub-pixel with the background pattern being blank indicates that the current partial output frame does not include the corresponding sub-pixel data. Although the sub-pixels with the background pattern being blank indicates that the current partial output frame does not include the corresponding sub-pixel data, such sub-pixel may still continuously display the corresponding sub-pixel data in the previous partial output frame.

Figure 12A:
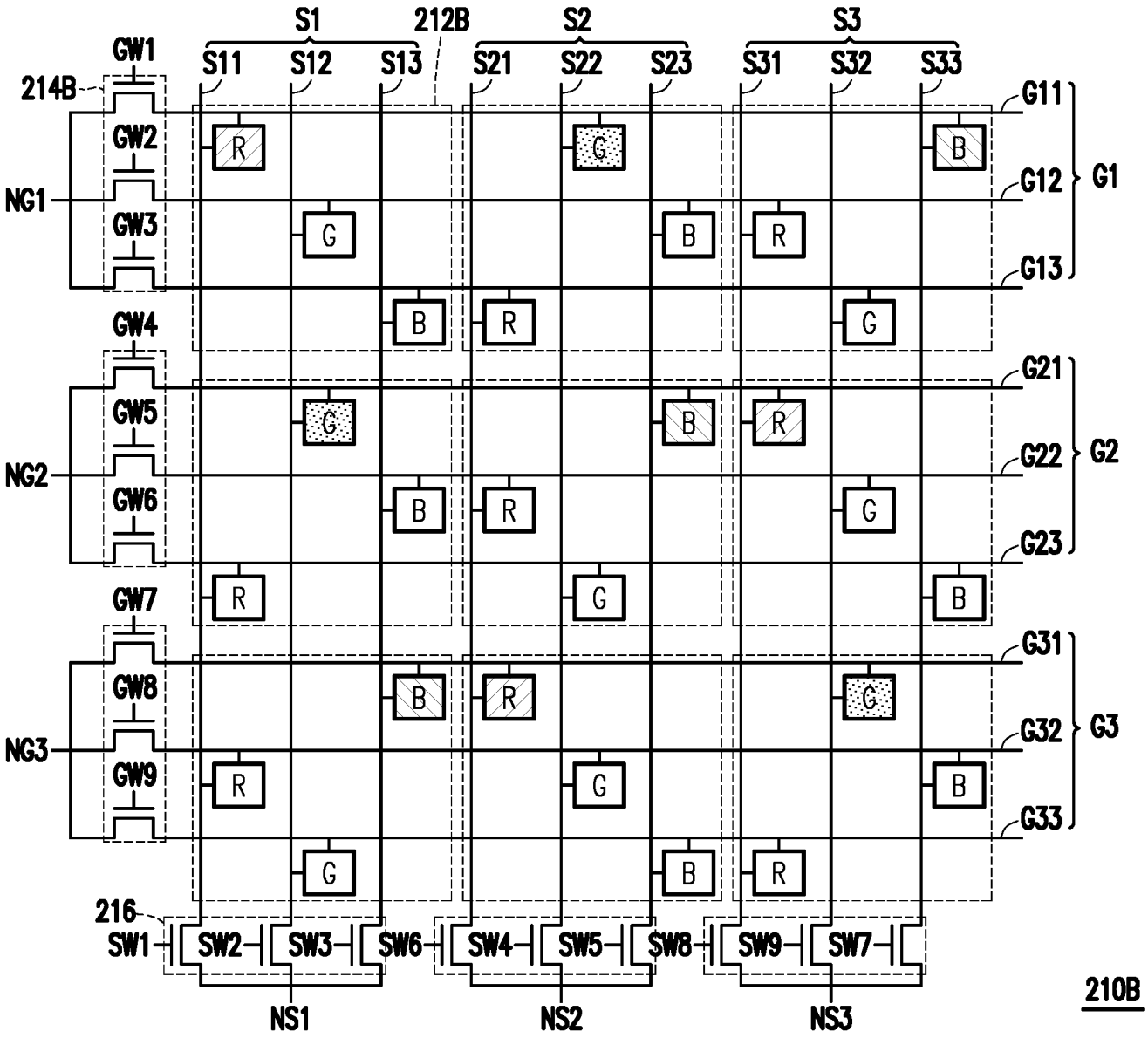
FIG. 12A, FIG. 12B and FIG. 12C are schematic diagrams illustrating a display panel and image data being written into pixels on the display panel in another embodiment of the invention.
Figure 12B:
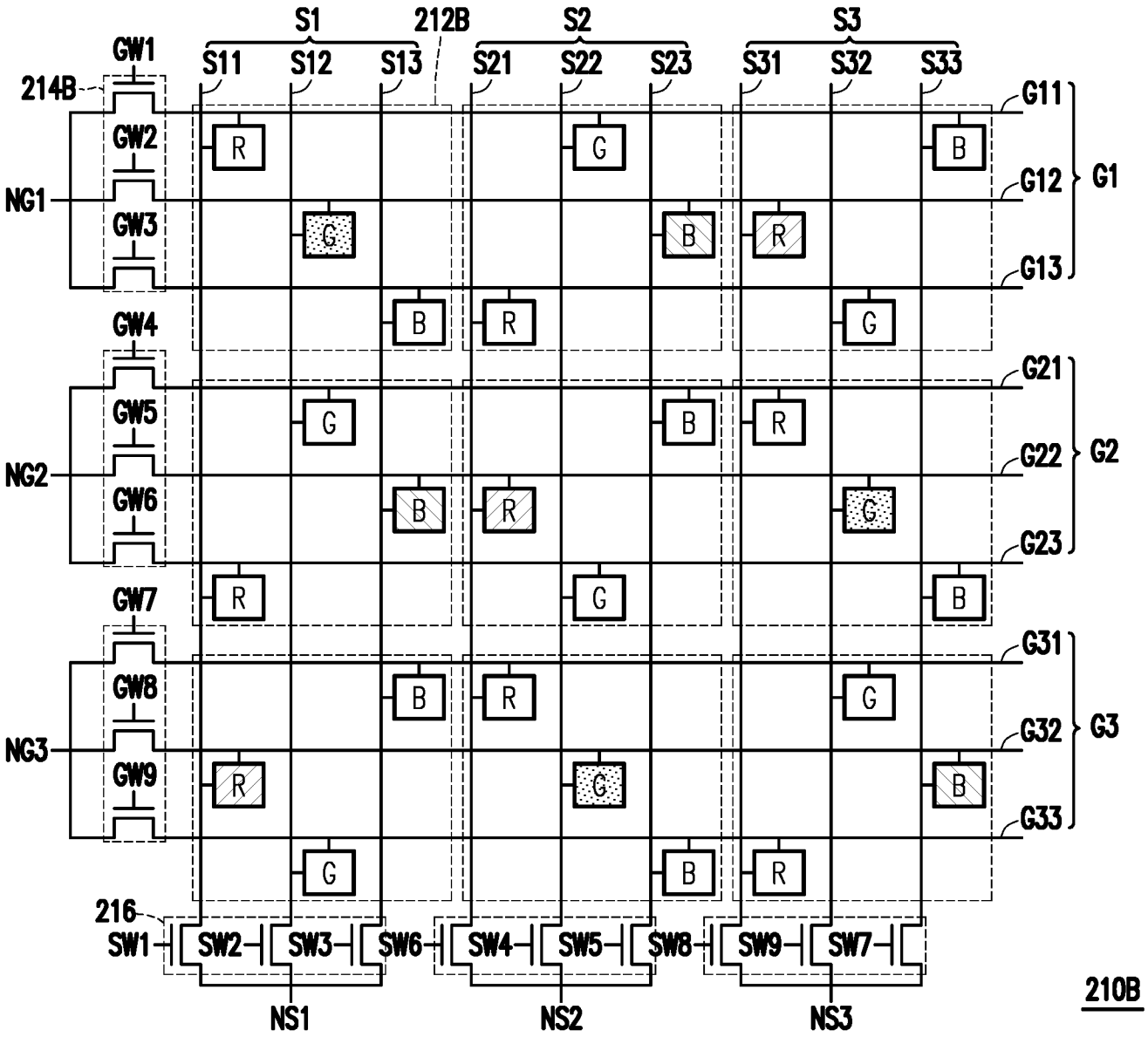
Figure 12C:
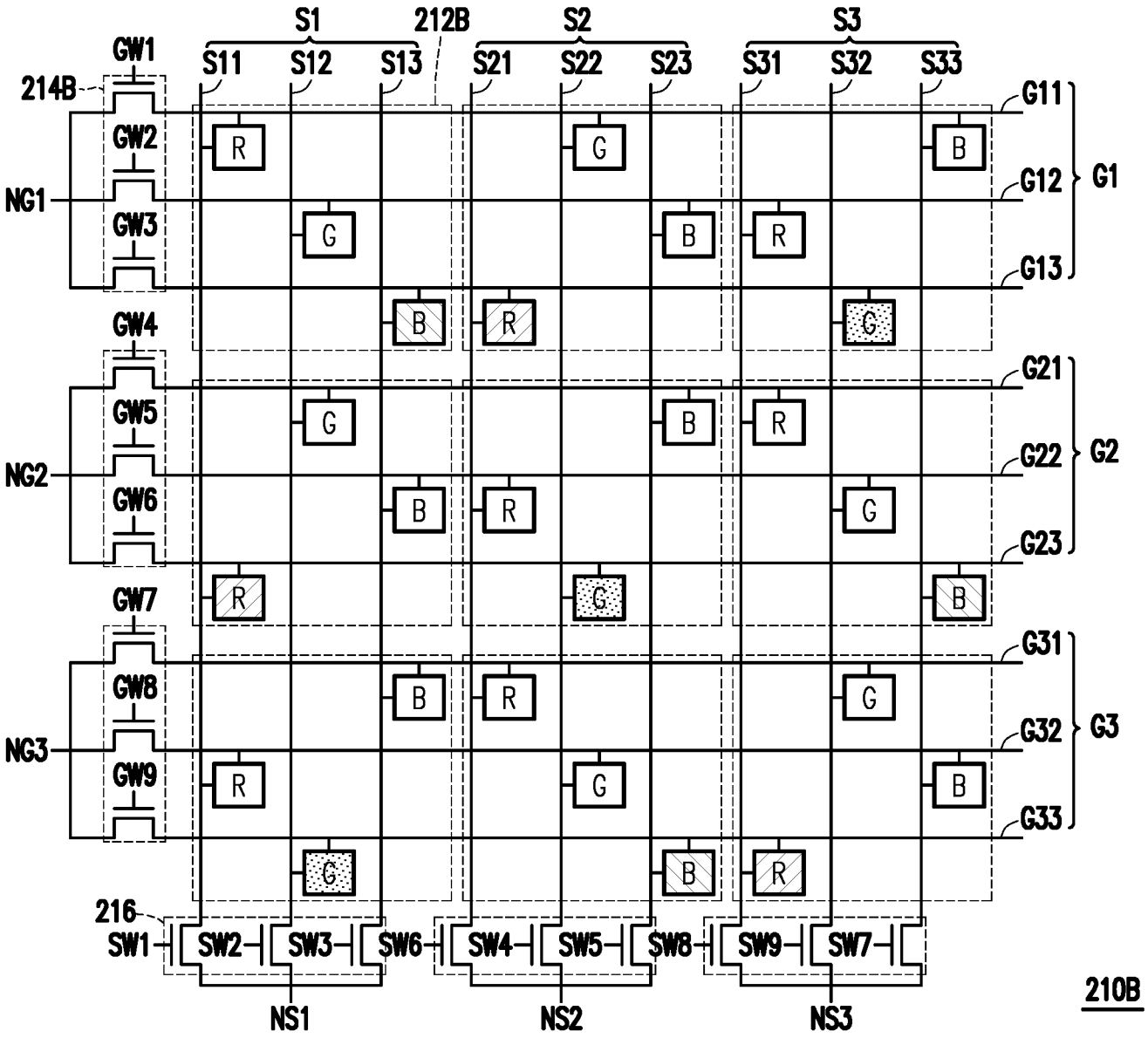
Figure 13:
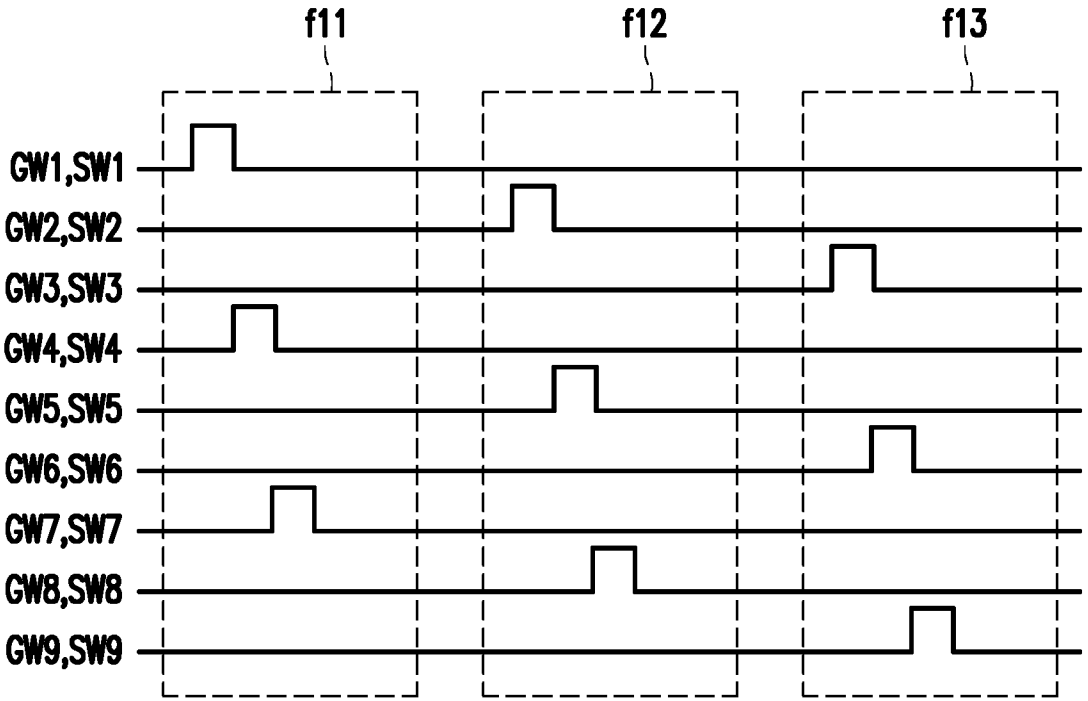
FIG. 13 is a schematic diagram illustrating control signals of the display panel in the embodiment of FIG. 12A to FIG. 12C.

FIG. 12A to FIG. 12B are schematic diagrams illustrating a display panel and image data being written into pixels on the display panel in another embodiment of the invention. A display panel 210B is an embodiment of the display panel 210 of FIG. 9. FIG. 13 is a schematic diagram illustrating control signals of the display panel in the embodiment of FIG. 12A to FIG. 12C. A timing sequence illustrated in FIG. 13 may be used to control three consecutive partial output frames f11 to f13 to be displayed on the display panel 210B. With reference to FIG. 12A to FIG. 13, in the present embodiment, the display panel 210B includes a plurality of pixel rows, a plurality of data line groups S1, S2 and S3, a plurality of data signal switching units 216, a plurality of scan line groups G1, G2 and G3 and a plurality of scan signal switching units 214B. Each of the data signal switching unit 216 and the scan signal switching unit 214B includes a plurality of switch elements. FIG. 13 illustrates a plurality of control signals GW1 to GW9 and SW1 to SW9. When there is no data updating (i.e., no data voltage outputted), sub-pixels of the display panel 210B can last for a while with the data voltages other than not displaying at all.

In the present embodiment, the pixel row includes a plurality of pixels 212B. Each pixel includes three sub-pixels R, G and B. The data line group S1 includes three data lines S11, S12 and S13 coupled to the three pixels R, G and B, respectively. The data signal switching unit 216 is configured to couple a data signal input terminal (NS1, NS2, NS3) to one data line in the data line group. The scan line group G1 includes three scan lines G11, G12 and G13. Each of the scan lines G11, G12 and G13 is coupled to one corresponding sub-pixel in each pixel. The scan signal switching unit 214B is configured to couple a scan signal input terminal (NG1, NG2, NG3) to one scan line in the scan line group. In the present embodiment, each scan line is coupled to at least one sub-pixel in each of the pixels of the pixel row, and a number of sub-pixels coupled by each scan line is less than a number of sub-pixels included by the pixel, as shown in FIG. 12A to FIG. 12C.

In addition, coupling relation of the sub-pixels with respect to the data lines S21, S22 and S23 of the data line group S2, the data lines S31, S32 and S33 of the data line group S3, the scan lines G21, G22 and G23 of the scan line group G2 and the scan line G31, G32 and G33 of the scan line group G3 may be derived with reference to the data line group S1, the scan line group G1 depicted in FIG. 12A to FIG. 12C. In the present embodiment, each element, the coupling relation among the elements and the number of the signals are merely examples rather than limitations to the invention.

With reference to FIG. 12A to FIG. 13, FIG. 12A illustrates the situation where the display driver 220 writes the partial output frame f11 in FIG. 5A into the pixels in the display panel 210B. FIG. 12B illustrates the situation where the display driver 220 writes the partial output frame f12 of FIG. 5A into the pixels in the display panel 210B. FIG. 12C illustrates the situation where the display driver 220 writes the partial output frame f13 of FIG. 5A into the pixels in the display panel 210B. In FIG. 13, dotted boxes marked by f11, f12 and f13 represent waveform diagrams of the control signal of each switch element when the partial output frames f11, f12 and f13 are written into the display panel 210B, respectively. The control signal at high level can control the corresponding switch element to be turned on so the sub-pixel data can be written into the corresponding sub-pixel. The operating method for the rest of the partial output frames in FIG. 5A and FIG. 5B to be written into the display panel may be derived from the above. In the present embodiment, it is not required to have the partial output frame VOUT1 outputted by the image data processor unit 122 reconstructed but simply outputted by the display driver 220 for driving the display panel 210B. The sub-pixel marked with the background pattern in FIGS. 12A and 12B indicates that the current partial output frame (f11 or f12 or f13) includes the corresponding sub-pixel data, whereas the sub-pixel with the background pattern being blank indicates that the current partial output frame does not include the corresponding sub-pixel data. Although the sub-pixels with the background pattern being blank indicates that the current partial output frame does not include the corresponding sub-pixel data, such sub-pixel may still continuously display the corresponding data in the previous partial output frame.

In addition, sufficient teaching, suggestion, and implementation regarding an operation method of the display apparatus and the method for generating the display data of the display panel of FIG. 8 to FIG. 13 may be obtained from the foregoing embodiments of FIG. 1 to FIG. 7, and thus related descriptions thereof are not repeated hereinafter. It is noted that the number of switch elements of the data signal switching unit 216, the coupling relationships between switch elements and data lines, the number of switch elements of the scan signal switching unit 214A or 214B, and the coupling relationships between switch elements and scan lines illustrated in the display panel 210A in FIGS. 10A and 10B and the display panel 210B in FIGS. 12A to 12C are some of embodiments of the invention and are not limitations. In other embodiments, the number of switch elements of the data signal switching unit 216 may be two or another proper quantity; switch elements of each data signal switching unit 216 are not limited to couple to adjacent data lines; the number of switch elements of the scan signal switching unit 214A or 214B may be determined based on the number of input frames of each cycle for updating sub-pixel data; and, switch elements of each scan signal switching unit 214A or 214B are not limited to couple to adjacent scan lines.

In an exemplary embodiment of the invention, each of the display driver, the image enhancement unit, the image data processor unit, the image compression unit, the storage unit, the image decompression unit, the image input unit, the data reconstruction unit and the processor may be implemented by any hardware or software in the field, which is not particularly limited in the invention. Enough teaching, suggestion, and implementation illustration for detailed implementation of the above may be obtained with reference to common knowledge in the related art, which is not repeated hereinafter.

In summary, according to the exemplary embodiments of the invention, in the display driver and the method for generating the display data of the display panel, the display processing includes the sub-pixel rendering operation. With the sub-pixel rendering operation performed by the image data processor unit on the input image data to generate the output image data, the data transmission amount of the image data in the device or between devices may be reduced. Moreover, in the exemplary embodiments of the invention, data structure of the partial output frames generated by the sub-pixel data rendering operation may be adjusted according to arrangements of sub-pixels on the display panel.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A display apparatus, comprising:

a display panel, comprising:

a pixel row, comprising a plurality of pixels, each of the pixels comprising K sub-pixels, wherein K is a positive integer;

a data signal input terminal;

a data line group, comprising N data lines respectively coupled to N sub-pixels, wherein N is a positive integer;

a data signal switching unit, configured to couple the data signal input terminal to one data line in the data line group;

a scan signal input terminal;

a scan line group, comprising M scan lines, wherein the number of sub-pixels coupled to each of the scan lines being less than the number of sub-pixels included in each pixel, wherein M is a positive integer; and a scan signal switching unit, configured to couple the scan signal input terminal to one scan line in the scan line group, an image data processor unit, configured to perform a sub-pixel data rendering operation on a plurality of input frames to generate a plurality of partial output frames, wherein the sub-pixel rendering operation comprises calculating a plurality of sub-pixel data having an identical color in each of the input frames by the image data processor unit according to a set of color diffusion ratios, wherein with respect to a pixel of the display panel, each of the partial output frames comprises a part, instead of all, of sub-pixel data to be displayed by the pixel; and a display driver, coupled to the image data processor unit and the data signal input terminal of the display panel.

2. The display apparatus according to claim 1, wherein the input frames are included in a cycle with every P input frames per one cycle, and with respect to the pixel in the display panel, the image data processor unit performs the sub-pixel data rendering operation on a plurality of sub-pixel data related to a part, instead of all, of sub-pixels in the pixel in each of the input frames, so as to generate a plurality of sub-pixel data to be displayed by the part of the sub-pixels in the pixel in each of the partial output frames, wherein P is an integer greater than or equal to 2.

3. The display apparatus according to claim 2, wherein the input frame comprises a first input frame and a second input frame temporally subsequent to the first input frame, wherein the image data processor unit performs the sub-pixel rendering operation on a plurality of first-color sub-pixel data in the first input frame, so as to generate the corresponding first-color sub-pixel data to be displayed by the pixel in a first partial output frame, and the image data processor unit performs the sub-pixel rendering operation on a plurality of second-color sub-pixel data in the second input frame, so as to generate the corresponding second-color sub-pixel data to be displayed by the pixel in a second partial output frame.

4. The display apparatus according to claim 1, wherein the sub-pixel rendering operation comprises calculating the plurality of sub-pixel data having the identical color in each of the input frames by the image data processor unit according to the set of color diffusion ratios, so as to generate a sub-pixel data to be displayed by the pixel in each of the partial output frames.

5. The display apparatus according to claim 1, wherein the display apparatus comprises a processor, the image data processor unit is disposed in the processor, the processor outputs the partial output frames to the display driver, and the display driver generates one or more corresponding data voltages according to the part of the sub-pixel data corresponding to the pixel in each of the partial output frames for driving a part, instead of all, of sub-pixels in the pixel.

6. The display apparatus according to claim 5, wherein the display driver is further coupled to the scan line input terminal of the display panel, and in a period during which the display driver outputs a scan signal to one scan line in the scan line group through the scan signal switching unit, the display driver outputs said one or more corresponding data voltages through the data signal switching unit for driving the part of the sub-pixels in the pixel.

7. The display apparatus according to claim 5, wherein the processer further comprises an image compression unit, configured to compress the partial output frames and output the compressed partial output frames, and wherein the display driver further comprises an image decompression unit, configured to decompress the compressed partial output frames, so as to generate the decompressed partial output frames.

* * * * *